United States Patent [19]

Wahl

[11] Patent Number: 4,592,345

[45] Date of Patent: Jun. 3, 1986

[54] BACK MASSAGER STRUCTURE

[75] Inventor: Gregory S. Wahl, Sterling, Ill.

[73] Assignee: Wahl Clipper Corporation, Sterling, Ill.

[21] Appl. No.: 561,557

[22] Filed: Dec. 14, 1983

[51] Int. Cl.[4] ..... A61H 23/02

[52] U.S. Cl. ..... 128/33; 128/41; 29/417; 297/452

[58] Field of Search ..... 29/417; 128/25 R, 25 B, 128/33–36, 31, 39, 41, 44–46, 48, 49, 51, 52, 56, 57, 67; 188/32; 74/89.17, 89.18, 40, 51, 422; 366/111; 272/73, 134, 900; 5/60–65, 108, 109, 423, 449, 453, 433, 462, 464, 469; 269/328, 325, 60, 69; 297/337, 338, 345, 346, 423, 429, 374, 375, 377, 452

[56] References Cited

U.S. PATENT DOCUMENTS

| | | | |
|---|---|---|---|
| 972,712 | 10/1910 | Palmer | 5/433 |
| 2,539,712 | 1/1951 | Wettlaufer | 128/33 |
| 2,939,454 | 6/1960 | Lichtenstein | 128/33 |
| 3,075,101 | 1/1963 | Neff | 128/41 |
| 3,161,436 | 12/1964 | Hood | 297/452 |
| 3,707,764 | 1/1973 | Frankovich | 29/417 |
| 3,854,474 | 12/1974 | Carruth | 128/33 |
| 3,874,729 | 4/1975 | Blodee | 297/452 |
| 4,256,096 | 3/1981 | Budde | 5/433 |
| 4,354,067 | 10/1982 | Yamada | 128/33 |

FOREIGN PATENT DOCUMENTS

| | | | |
|---|---|---|---|
| 2107576 | 5/1983 | United Kingdom | 297/452 |

*Primary Examiner*—Clyde I. Coughenour

*Attorney, Agent, or Firm*—Laff, Whitesel, Conte & Saret

[57] ABSTRACT

A back massager has folded padding, and upper pillow padding with a frame between the folded padding. The frame has a narrow upper portion and a wide lower portion with two arm portions having an opening between them. A casing comprising two metal pan halves has flat peripheral edges and contains a vibratory means which is attached in the open portion of the frame.

5 Claims, 6 Drawing Figures

BACK MASSAGER STRUCTURE

The invention relates to back massagers. More particularly, the invention relates to back massagers that offer more comfortable, softer head sections and more concentrated massaging between the shoulder blades.

Back massagers, such as those described in U.S. Pat. Nos. 4,006,739 and 4,022,195, which are owned by the assignee of the present invention, comprise portable cushions with front and rear padding. An elongated, rectangular rigid or semi-rigid board or frame is inserted between the front and rear padding. A cut-out portion in a lower section of the frame holds a casing containing a vibratory motor of the massager. A suitable electrical cord connects the vibratory motor to a control switch and to an electrical outlet. Also, a heating system may be used with the portable cushion to apply heat alone or in conjunction with massaging vibrations.

With this structure, the strongest vibratory effect is delivered through the lower portion of the cushion to the back of the user at the lumbar region or small of the back. A more gentle vibrating effect is given to the middle and upper portions of the cushion in the area of the user's shoulders, neck and head.

One problem with these previous back massagers is that the upper portion of the cushion underneath the head of the user, contains the rigid or semi-rigid board-like frame. The frame prevents the cushion under the head from being sufficiently soft and comfortable. Also, the board-like frame under the head of the user vibrates, causing unnecessary and sometimes irritating head movement. It is desirable for back massagers to concentrate vibrations on the neck, shoulders and back, while the user's head remains relaxed.

Further, it is usually preferred for back massagers to have the upper body massaging action concentrated between the user's shoulder blades. The board-like frame construction of previous back massagers does not concentrate vibrations between the shoulder blades, but rather gives off a general vibration across the entire upper back and shoulders.

Yet another problem with previous back massagers is that the frame is almost as long and wide as the cushion itself, making the cushion heavy and bulky. Also, when the frame is manufactured, a portion is cut out where the casing for the vibratory motor is inserted, and this cut-out portion of the frame is wasted material.

An object of the invention is to provide back massagers which have a soft pillow section. Another object is to provide back massagers which enable a concentration of massaging between the shoulder blades rather than in the head section. Yet another object is to provide a lighter overall cushion and to reduce the cost of production of back massagers.

According to an aspect of the invention, a back massager comprises a cover containing folded padding and a frame between the padding. The frame has an upper portion and two arm portions defining an open portion between them. A casing containing a vibratory motor is attached to the frame at the open portion.

The invention will best be understood by reference to the following description and the attached drawings in which.

Figure 1:
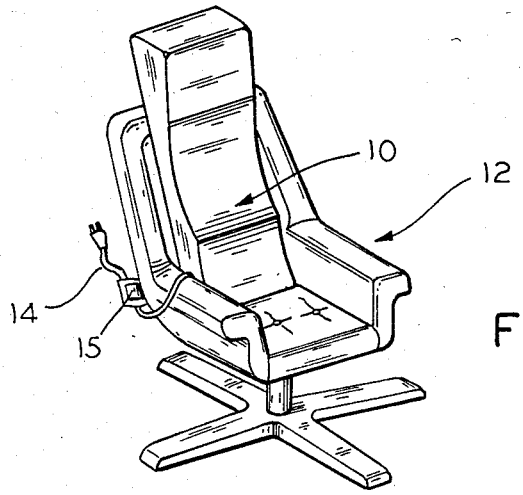
FIG. 1 is a perspective view of a back massager in a chair.

In FIG. 1 a portable back massager 10 containing a vibratory motor is positioned on the back of a chair 12. The massager 10 includes an electrical cord 14 for connecting the vibratory motor within the cushion to an electrical outlet. A switch 15 enables easy control of the vibrating motor. The massager 10 can be removed from the chair 12 and used in any other suitable place, such as flat on the floor.

Figure 2:
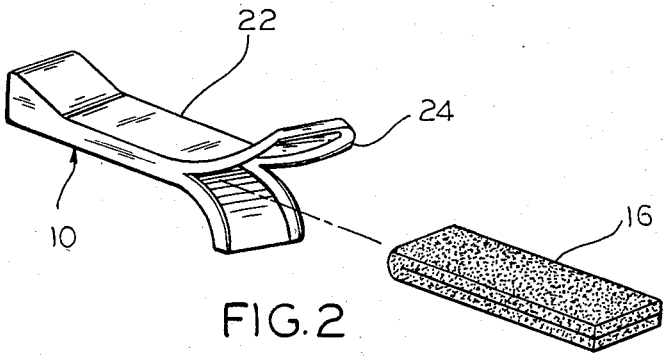
FIG. 2 is a perspective view of the cover and padding of the back massager showing how the padding is inserted in the cover.
Figure 3:
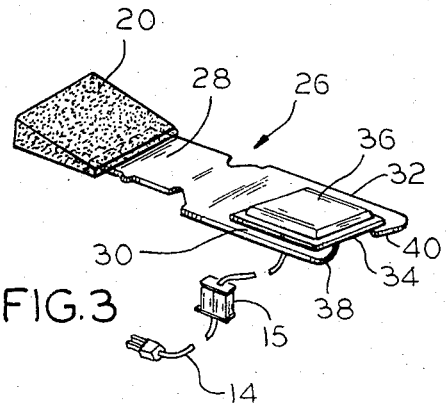
FIG. 3 is a perspective view of the back massager frame, with the casing containing the vibratory motor mounted on the frame.

As shown in FIGS. 2 and 3, the portable back massager 10 comprises a cover 22, folded padding 16 and a frame 26. The cover 22 can be made of any suitable upholstery fabric or material, such as vinyl or leather, and is stitched, glued or fastened together by closure means 24 such as hook and loop fasteners, snaps or a zipper.

The frame 26 (FIG. 3) is placed between the folded padding 16 and comprises an upper portion 28 and lower arm portions 30, 32 with an open portion 34 between the arms. Pillow padding 20 is fastened to the end of the upper portion 28 of the frame. A casing 36 for the vibratory mechanism is inserted in the open portion 34 and attached to the frame 26. The arm portions 30, 32 have curved ends 38, 40 which help to prevent tears in the closure means 24 after the frame 26 is inserted in the cover 22.

The back massager frame 26 may be made of any flat sheet of suitable rigid, or semi-rigid material which will not break under the weight of the person using the cushion. Preferably the frame 26 is a composition, hardboard or fiberboard.

Figure 5:
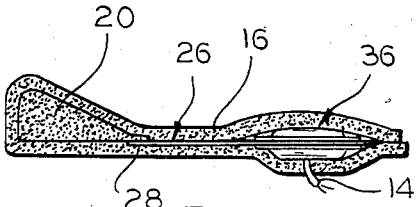
FIG. 5 is a side elevational view of the padding and frame before it is placed in the cover of the inventive back massager.

As best seen in FIG. 5, the length of the frame 26 is shorter than the folded length of the padding 16 so that the frame does not extend into the uppermost portion of the massager or area of the pillow padding 20 of the cushion under the user's head. In this manner, the frame 26 enables a soft, comfortable head cushion and prevents vibrations of the frame under the user's head.

The width of the upper portion 28 of the frame is narrower than the total width of the frame across the arms 30, 32 and the open portion 34. This causes the upper portion 28 of the frame 26 within the cushion to lie substantially between the shoulder blades of the user, so that the vibrations of the frame are concentrated between the shoulder blades. The shortened length and narrowed upper portion of the back massager frame also enables the overall weight of the massager 10 to be lighter and less bulky than previous massagers.

Figure 4:
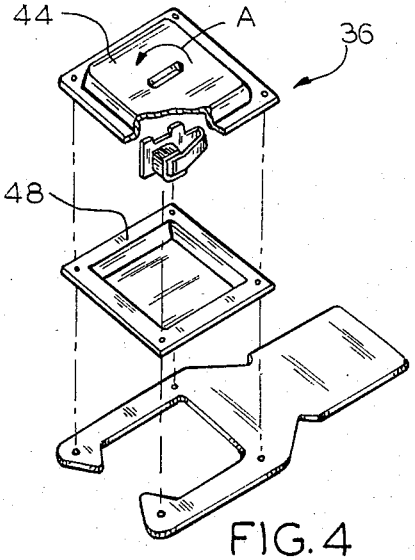
FIG. 4 is an exploded view of the back massager frame and casing containing the vibratory motor.

The exploded view of FIG. 4 shows how the casing 36 containing the vibratory motor 42 is easily and securely attached to the frame 26. The casing 36 comprises two preferably metal pan halves 44, 46. The vibratory motor 42 is mounted within the pan halves 44, 46 by any suitable method. The pan halves 44, 46 have flat peripheral edges which are first welded, screwed or otherwise attached together enclosing the vibratory motor 42. The pan halves are welded together at points 48, 50, 52 and 54. As shown by arrow A in FIG. 4, the motor 42 and both pans 44, 46 can be rotated ninety (90) degrees for different vibration action and direction. The casing 36 is then stapled or otherwise securely attached to the frame over the open portion 34 as at the four corners of pans 44 and 46.

The vibratory motor 42 may be any suitable type of device such as a somewhat U-shaped piece with a core attached to the pan at one leg of the U-shaped piece and a wire coil mounted around the other leg. When the wire coil is energized, a side of the U-shaped piece alternately moves toward and away from the opposite leg. The vibratory motor 42 vibrates the casing 36, which in turn vibrates the frame 26 and the surrounding massager 10.

As best seen in FIG. 5, the frame 26 with the attached casing 36 is inserted between folded padding 16 so that the casing 36 will be located in the lower one-third of the massager. The casing 36 produces a bulge which more closely fits the lumbar region or small of the user's back.

Figure 6:
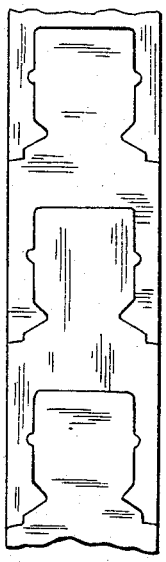
FIG. 6 is a plan view of an assembly line showing that the back massager frames can be cut out of a continuous piece of material with little waste.

FIG. 6 shows how the back massager frame is manufactured from a continuous piece of the fiberboard or other suitable material. The cut-out piece for the open portion 34 lies between the arm portions 30, 32, and serves as the upper portion 28 of the next frame. Thus, a continuous line of frames can be manufactured on a punch press, with almost no wasted material.

There are many advantages to the improved back massager. First, the massager offers a more comfortable and satisfying massage to the user with more concentrated vibrations between the shoulder blades, and little vibration under the user's head. Second, the improved massager is lighter in weight than previous back massagers due to the shortened and narrowed frame. Third, the casing for the vibratory mechanism is easily and securely attached to the frame of the massager. Fourth, the massager frame can be manufactured with little waste of material, and the small frame makes the massager less expensive to make than previous massagers.

Those who are skilled in the art will readily perceive how to modify the invention. Therefore, the appended claims are to be construed to cover all equivalent structures within the true scope and spirit of the invention.

I claim:

1. A massager comprising:

a first padded portion to be located adjacent a first portion of the anatomy of an individual, and a second padded portion disposed at a spaced distance from said first padded portion, said second padded portion adapted to be located adjacent a second portion of the anatomy of said individual;

a semi-rigid frame member, said frame made from a substantially flat material, said frame member having a first portion extending beneath said first padded portion, and a second portion extending beneath said second padded portion;

said first portion of said second frame member comprising two extending arm portions and an open section between said arms defining a cut-out area;

a casing attached at the open section of said frame, said casing including therein vibratory means to create a vibrating motion in said frame member;

said second portion of said frame member comprising a substantially flat portion being shaped such that the external profile of said second portion of said frame member is substantially the same as the internal profile of said cut-out area of said first portion of said frame member;

whereby a portion of said vibrating motion is transmitted through said second portion of said frame member to said second padded portion and to said second portion of the anatomy of said individual, and another portion of said vibrating motion is transmitted through said first portion of said frame member to the first portion of the anatomy of said individual, and cover means enclosing said first and second padded portions and said semi-rigid frame member.

2. The massager of claim 1 including a pillow wherein said second portion of said frame member extends up to the edge of said pillow.

3. The massager of claim 1 wherein said casing comprises two pan halves having flat peripheral edges which are fastened together and attached to said open section between the arms of said frame.

4. The massager of claim 1 wherein said first padded portion of said massager is adapted to be located adjacent the lower back portion of said individual.

5. The massager of claim 1 wherein said second padded portion of said massager is adapted to be located adjacent the neck and shoulder portion of said individual.

* * * * *